US006334318B1

(12) United States Patent
Ando et al.

(10) Patent No.: US 6,334,318 B1
(45) Date of Patent: Jan. 1, 2002

(54) AUTOMATIC ICE MAKING APPARATUS

(75) Inventors: Hitoshi Ando; Eiji Kuroda; Atsuo Nakayama; Kentaro Yamane; Naoko Toida; Kazufumi Yamashita; Yasushi Niwa, all of Gunma (JP)

(73) Assignee: Japan Servo Co., Ltd., Gunma (JP)

( * ) Notice: Subject to any disclaimer, the term of this patent is extended or adjusted under 35 U.S.C. 154(b) by 0 days.

(21) Appl. No.: 09/410,128

(22) Filed: Sep. 30, 1999

(30) Foreign Application Priority Data

Oct. 1, 1998 (JP) ..... 10-279506
Apr. 5, 1999 (JP) ..... 11-097274

(51) Int. Cl.[7] ..... F25C 1/00
(52) U.S. Cl. ..... 62/135; 62/351
(58) Field of Search ..... 62/135, 351, 353

(56) References Cited

U.S. PATENT DOCUMENTS 4,649,712 A 3/1987 Tate, Jr. et al. ..... 62/137
4,649,717 A 3/1987 Tate, Jr. et al. ..... 62/340
4,649,718 A 3/1987 Linstromberg ..... 62/340
4,665,708 A 5/1987 Tate, Jr. et al. ..... 62/66
4,799,362 A 1/1989 Chestnut ..... 62/127
4,833,894 A * 5/1989 Chesnut ..... 62/351
4,848,097 A * 7/1989 Roberts ..... 62/135
5,010,738 A 4/1991 Brown et al. ..... 62/135
5,182,916 A * 2/1993 Oike et al. ..... 62/353
5,768,899 A * 6/1998 Lee et al. ..... 62/353

* cited by examiner

*Primary Examiner*—William Doerrler
*Assistant Examiner*—Mohammad M. Ali
(74) *Attorney, Agent, or Firm*—Nilles & Nilles, S.C.

(57) ABSTRACT

An automatic ice making apparatus having a sensor which can detect continuously a temperature of an ice making tray is used as a temperature sensor. The temperature and a temperature variation rate of the ice making tray are detected by an electronic control circuit having a function corresponding to an A/D converter and a microprocessor or the like to determine a freezing state of water. Further, a thermistor is used as the temperature sensor, and by and A/D converter including a microprocessor a water level in the ice making tray is detected and a solenoid valve for determining an amount of supply water is controlled so as to suppress the water amount variation due to a water pressure change or the like.

11 Claims, 5 Drawing Sheets

AUTOMATIC ICE MAKING APPARATUS

FIELD OF THE INVENTION

The present invention relates to an automatic ice making apparatus for use in a home refrigerator.

BACKGROUND ART

In a first example of conventional automatic ice making apparatus, the state of freeze of water is determined by a thermostat mounted on an ice making tray, and the thermostat is used for sensing the temperature and for switching over an electric heater or an ice discharging motor, for example. In such automatic ice making apparatus, the operation temperature of the thermostat is set generally to about minus 10° C. When the thermostat is operated at a temperature of about minus 10° C., a contact of switch of the thermostat is closed to energize the electric heater mounted on the ice making tray, so that the ice making tray is heated, the surface of ice contacted to the ice making tray is melted, and the ice is removed from the ice making tray.

The ice discharging motor for use in an ice discharging mechanism is energized at the same time of the switching over of the thermostat by the switching function thereof, however, the motor is deenergized when a claw for discharging ice is brought into contact with the ice, and then the motor is energized when the ice is removed from the ice making tray to discharge the ice from the ice making tray. It is a matter of course that the ice discharging motor is of the type to be remained in the deenergized state for a while.

The hysteresis property is applied to the thermostat in order to separate positively the ice from the ice making tray. That is, the switch contact of the thermostat is turned ON at about minus 10° C. and turned OFF at about plus 10° C. Due to the hysteresis property, when the temperature of the ice making tray is elevated to about plus 10° C., the switch contact of the thermostat is turned OFF to deenergize the electric heater.

A cam for operating two limit switches is provided on the ice discharging motor. One of the limit switches serves as to turn ON or OFF an electromagnetic valve for supplying water. The other of the limit switches is connected in parallel with the switch contact of the thermostat, so that the ice descharging motor is rotated continuously even if the switch contact of the thermostat is turned OFF. After the ice has been discharged perfectly, the ice discharging motor is still rotated, and the electromagnetic valve is energized by the cam and the limit switch for a period of time determined by the number of rotation of the motor and the figure of the cam so as to supply water.

Then the ice discharging motor is deenergized and the water supply is stopped. The above is a cycle of the ice making.

In a second example of the conventional automatic ice making apparatus, the state of freeze of water is determined by such a control system that the temperature of an ice making tray is detected by using a thermistor mounted on the ice making tray as a temperature sensor, and an output voltage of the thermistor is compared to a predetermined value and judged by a comprator whether the temperature of the ice making tray is higher or lower than the predetermined temperature. The automatic ice making apparatus of this system is similar basically to the first example of the conventional automatic ice making apparatus except that in the second example of the automatic ice making apparatus a semiconductor switch is used as a power switch for the electric heater and the motor.

FIG. 5 shows a conventional ice making means comprising an ice making tray 11 provided with a thermostat 12 and a heater 13, and an ice discharging motor 14 for an ice discharging mechanism provided with an ice discharging claw 15, a cam 16, a contact LS1 for the cam 16, a cam 17 and a contact LS2 for the cam 17, wherein ice 18 in the ice making tray 11 can be discharged by rotating the claw 15. Further, water is supplied from a water supply pipe 19 into the ice making tray 11 through an electromagnetic valve 20.

When the ice 18 of a predetermined quantity is discharged by the ice discharging mechanism and stored in an ice storing box 21, a sensor 22 detects the ice stored in the ice storing box 21 to stop the power supply from a power source 23 so as to stop temporarily the ice making operation.

When the amount of the ice in the ice storing box 21 is reduced, the power is supplied from the power source 23 to start the ice making operation.

In a state shown in FIG. 5, the amount of the ice in the ice storing box 21 is reduced, the ice making operation is started, a predetermined quantity of water is supplied into the ice making tray 11, and the electromagnetic valve 20 is deenergized. In this state, the thermostat 12 is turned OFF, so that no power is applied to the heater 13 and the motor 14. When the water in the ice making tray 11 is frozen and the thermostat 12 is turned ON, the heater 13 and the motor 14 are energized, so that the ice 18 contacted with the ice making tray 11 is melted and discharged into the ice storing box 21 by the claw 15 rotated by the motor 14 in the ice discharging mechanism. The rotation of the motor 14 is continued, so that the contact LS1 is turned ON by the cam 16. As a result, the electromagnetic valve 20 is operated to start the water supply, a quantity of water corresponding to the angular position of the motor 14 is supplied, and the ice making operation is restarted. The above motions are repeated until the sensor 22 for sensing the ice stored in the ice storing box is turned OFF.

In the conventional automatic ice making apparatus thus far described, the setting temperature of the ice making tray for freezing water positively is set to a value lower than a value required actually to freeze water so as to have a large play in consideration of the fluctuation in temperature in a freezing chamber, in mounting condition of the temperature sensor or the like. Accordingly, the conventional apparatus has such a defect that an ice making time becomes long, because a long time is required until the temperature of the ice making tray is lowered more than the temperature at which the temperature sensor is operated.

This problem will now be explained detail.

FIG. 1 shows ice making operation steps, temperature variations of the ice making tray and freezing states of water in one cycle of ice making operations of a general automatic ice making apparatus. First of all, the temperature of the ice making tray is maintained at a constant value substantially between a state that water on the ice making tray is frozen partially and a state that the water is frozen perfectly, because the ice making tray absorbs the heat of condensation.

After the freezing of water is completed, the temperature is lowered, because no heat of condensation is generated. When the temperature sensor detects the freeze of water, the electric heater is energized to elevate the temperature of the ice making tray, so that the ice contacted with the ice making tray is melted, and the ice is discharged to finish one cycle of the ice making operation.

In order to reduce the ice making time in the conventional automatic ice making apparatus, the setting value of a freeze judging temperature is approached as near as possible to the actual freezing temperature. However, the output value of the temperature sensor for the ice making tray, which may be maintained constant substantially while the water is condensed is fluctuated according to the temperature in the freezing chamber and the mounting condition of the temperature sensor or the like. Accordingly, a play according to the fluctuation must be necessary in the temperature setting. This results in the time until the sensor judges the freeze of water becomes about twice a time required for freezing the water actually in the automatic ice making apparatus practically used.

As stated in the first example of the prior art, the energization of the heater is controlled by the thermostat and accordingly a play must be added in the setting temperature similar to the control of the heater, so that the electric power supplied to the heater after the ice has been removed from the tray actually becomes wasteful.

In said conventional automatic ice making apparatus, further, there is an inconvenience such as the water overflow due to the water supply of plural times, and an abnormal stopping etc. in each operation of the water supply, cooling and heating for removing ice from the ice making tray.

Further, the electric heater for removing the ice from the ice making tray is deenergized by using a temperature fuse when the electric heater is overheated. Accordingly, the repair of the fuse is necessary when the temperature fuse is cut.

Further, it is a general manner that a solenoid valve for supplying water is opened for a constant period of time so as to supply a constant amount of water.

Further, in the apparatus having a water level detecting function using a thermistor, the water level is detected by self heating the thermistor by passing an overcurrent therethrough, and detecting the reduction of the temperature of the thermistor when the thermistor is immersed into the water.

If the solenoid valve for supplying water is opened for a constant period of time as in the prior art, a constant amount of water can be supplied under the condition that the water pressure in the water pipe is constant. However, the amount of supply water is reduced and the resultant amount of ice becomes small, if the water pressure is reduced, the ability of the solenoid valve for supplying water is lowered, or a filter for filtering water is clogged.

In the extra case, such an inconvenience that the apparatus is operated without supplying water would be generated.

If a dedicated sensor is used for the water level detection, the cost becomes high. Further, in the general water level sensor using a thermistor, an overcurrent is passed through the thermistor to heat it, and the water level is detected by the reduction of the temperature of the thermistor when the thermistor is immersed into the water. Accordingly, a circuit for applying an overcurrent to the thermistor other than a circuit for reading the output of the sensor must be added, so that the cost becomes higher.

ABSTRACT OF THE INVENTION

An automatic ice making apparatus according to the present invention is so constructed that a temperature and a temperature variation rate can be detected in sequence in an entire range of the temperature by using a sensor which can sense a temperature and a temperature variation rate of an ice making tray continueously and a detection circuit therefor.

According to the automatic ice making apparatus of the present invention, the freeze of water is judged by detecting not only a predetermined temperature but also the temperature variation rate, so that an influence of the fluctuation of the output value of the temperature sensor due to the temperature in the freezing chamber and the mounting condition of the temperature sensor can be reduced considerably. The judgement of freeze of water can be carried out by detecting a difference between the temperature variation rate in the course of freezing of water and the temperature variation rate after the freeze of water.

Further, a time between actual removing of ice and the deenergization of the heater can be shortened, so that the power comsumption can be reduced, because the precision of the judgement of the separation of ice is enhanced.

Further, in the automatic ice making apparatus according to the present invention, the temperature and the temperature variation rate of the ice making tray can be detected, so that the apparatus itself can recognize a current operation state in the operation steps shown in FIG. 1 or the abnormal state. For example, if the temperature is more than 0° C. and the temperature variation rate is minus, the operation state is judged as in the water cooling state after the water supply. If the temperature is lower than 0° C. and the temperature variation rate is zero, the operation state is judged as in the water freezing state. Accordingly, the actual operation state can be recognized and a suitable action can be carried out when the abnormal state is generated.

Further, an abnormal overheating state can be judged if the temperature is excessive, so that the operation of the apparatus can be stopped before the temperature fuse is cut.

Further, in the automatic ice making apparatus according to the present invention, a constant amount of water can always be supplied by using a control circuit for controlling the amount of water supply. Further, a water level detection sensor compatible with the temperature sensor for detecting the freeze of water can be used.

In the automatic ice making apparatus of the present invention, when the temperature variation of the ice making tray becomes a predetermined value, a water level of supplied water is determined as a required value by using a thermistor and a microprocessor including an A/D converter, so that a solenoid valve for supplying water is controlled.

No dedicating sensor for detecting the water level is added but the thermistor for detecting the freeze of water is therefor used.

Further, the elevation of the temperature is detected by the fact that the automatic ice making apparatus is installed in the freezing chamber, so that the thermistor of the cooled state is brought into contact with supplied water.

Other objects and features of the present invention will become apparent from the following description taking in connection with the accompanying drawings.

DESCRIPTION OF THE PREFERRED EMBODIMENTS

An embodiment of the present invention will be explained concretely with reference to FIG. 2 and FIG. 3.

Figure 1:
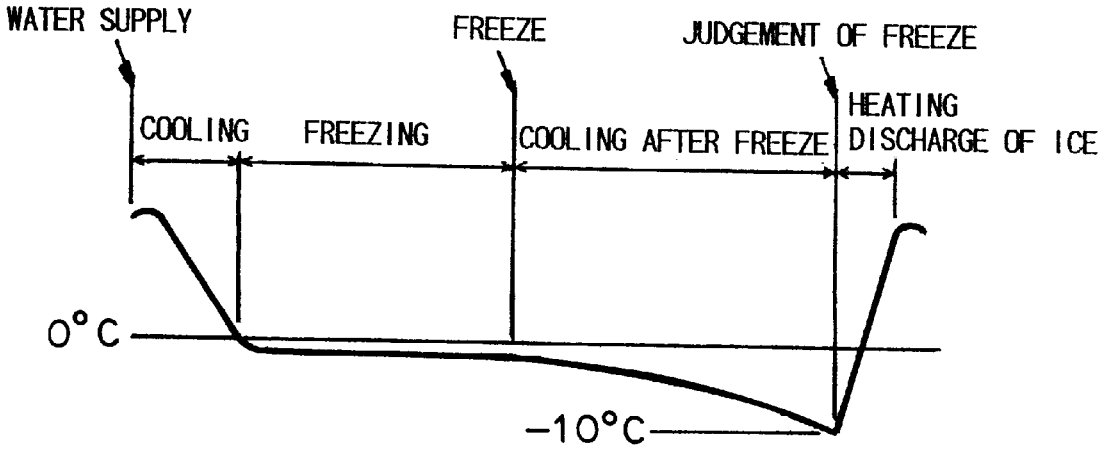
FIG. 1 shows ice making operation steps, temperature variations of an ice making tray and freezing states of water in one cycle of ice making operations of a general automatic ice making apparatus.
Figure 2:
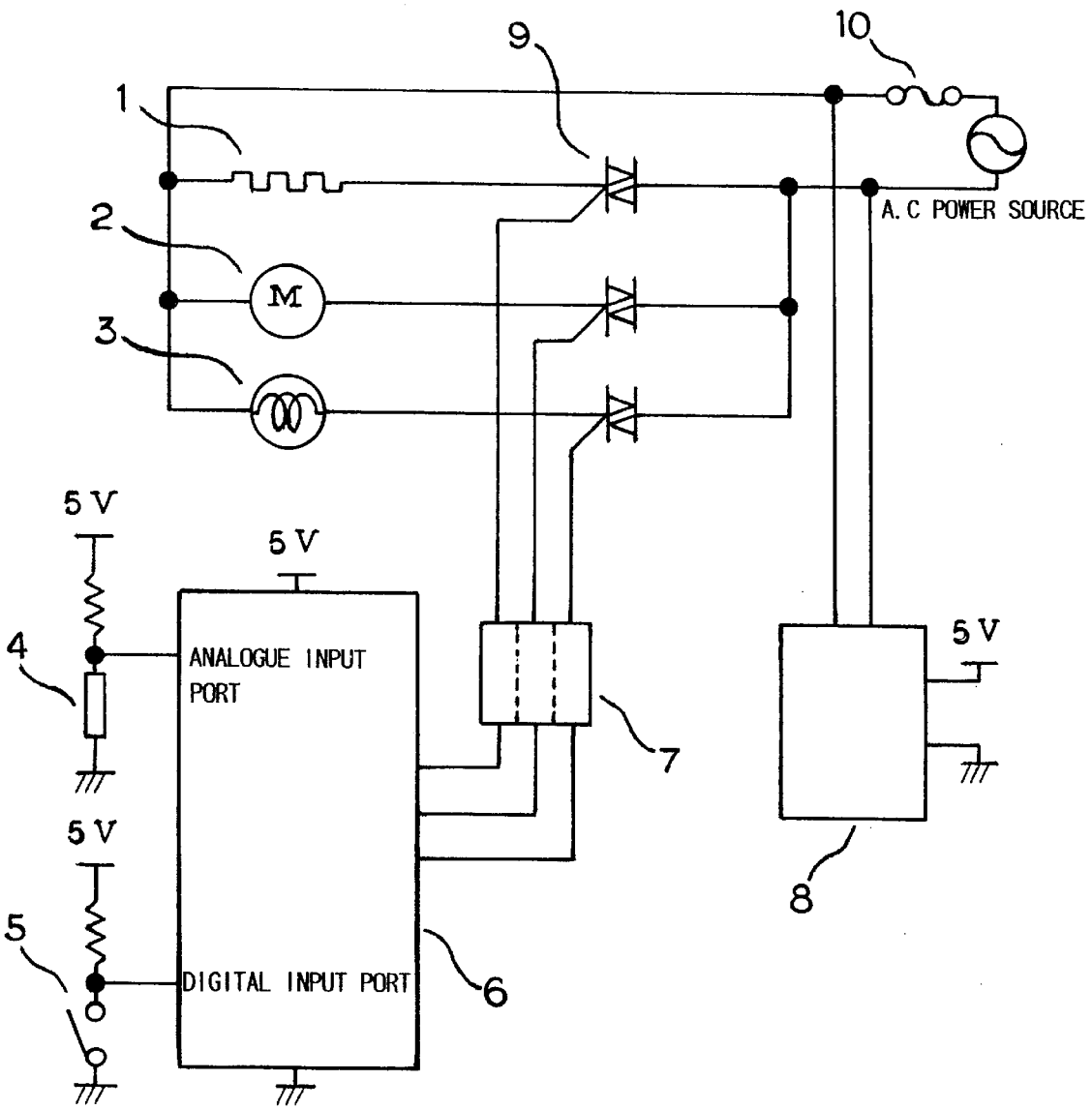
FIG. 2 shows a system block diagram of an embodiment according to the present invention.
Figure 3:
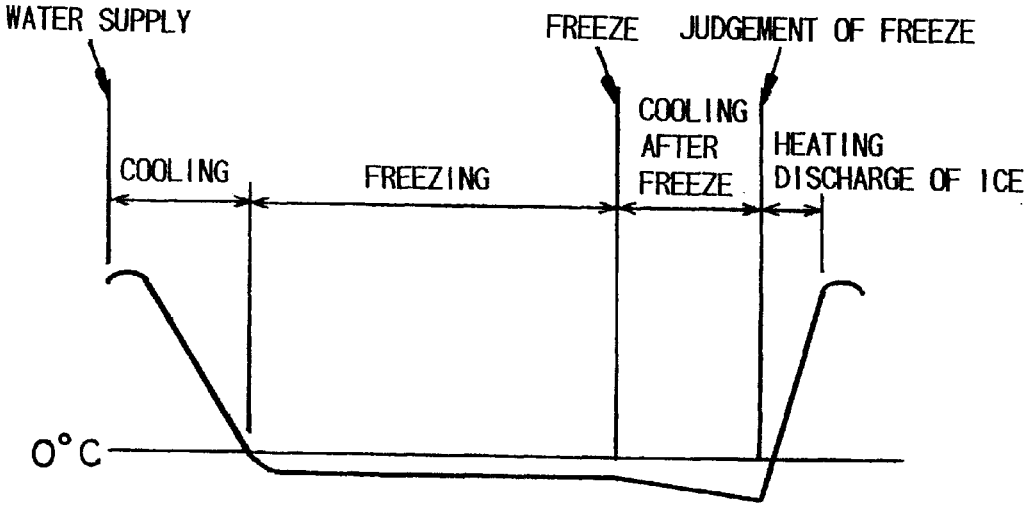
FIG. 3 shows ice making operation steps, temperature variations of the ice making tray and freezing states of water in one cycle of ice making operations of an automatic ice making apparatus according to the present invention.

FIG. 2 shows a system block diagram of an automatic ice making apparatus according to the present invention. FIG. 3 shows ice making operation steps, temperature variations of an ice making tray and freezing states of water in one cycle of ice making operations of the automatic ice making apparatus according to the present invention.

In FIG. 2, a reference numeral 1 denotes an electric heater mounted on the ice making tray for separating ice from the ice making tray, 2 denotes a single phase AC motor for discharging ice, 3 denotes a solenoid valve for supplying water, 4 denotes a thermistor for detecting the temperature of the ice making tray, 5 denotes a limit switch for a stored ice sensor to detect the fact that a predetermined amount of ice is stored in an ice storing bucket, 6 denotes a microprocessor including an A/D converter, 7 denotes a gate drive circuit for a triac, 8 denotes a circuit of a DC power source of 5 V, 9 denotes the triac, and 10 denotes a temperature fuse which is cut when the ice making tray is overheated. These parts are connected to one another as shown in FIG. 2.

First of all, the triacs 9 are turned ON when a control signal is applied thereto from the microprocessor 6 through the gate drive circuit 7, so that the solenoid valve 3 for supplying water is opened, and the water supply is started. The amount of supply water is controlled by a time during which the solenoid valve 3 for supplying water is opened. The microprocessor 6 reads sequentially the output voltage of the thermistor 4, A/D convertes it, and calculates the temperature and the temperature variation rate. After the water supply, the temperature of the ice making tray is lowered as shown in FIG. 3. The temperature variation rate becomes low when the freezing of water is started, because the ice making tray absorbs the heat of condensation of water and the temperature of the ice making tray is maintained constant substantially. The temperature variation rate becomes high when water is frozen perfectly, because no heat of condensation to be absorbed by the ice making tray is generated.

The microprocessor 6 detects the change of the temperature variation rate and judges that water is frozen perfectly. After the decision of the perfect freeze of water by the microprocessor 6, the triacs 9 are turned ON by the gate drive circuit 7 to energize the heater 1 and the ice discharging motor 2. When the ice discharging motor 2 is rotated and the claw of the ice discharging mechanism is brought into abutment with ice, the ice discharging motor 2 is deenergized for a while. The deenergized state of the ice discharging motor 2 is released and ice is discharged, when the temperature of the ice making tray is elevated by the heater 1 and a portion of ice contacting with the ice making tray is melted and separated from the ice making tray. After completion of the discharge of ice, the heater is deenergized and the claw of the ice discharging mechanism is stopped at a predetermined position, so that one cycle of the ice making operation is finished.

By repeating this cycle, the discharged ice is stored in the bucket for storing ice, and when the amount of ice reaches a predetermined value, the limit switch 5 for the stored ice sensor is operated. The microprocessor 6 detects the operation of the limit switch 5 to stop temporarily the ice making cycle. When ice is taken out of the bucket by the user, the limit switch 5 for the stored ice sensor is returned, and the microprocessor 6 detects the state and starts the ice making cycle again.

During the above continuous ice making cycle, the microprocessor 6 reads the output voltage of the thermistor 4 sequentially, A/D converts it and detects the temperature and the temperature variation rate to recognize the current operation step. In case that a door of the refrigerating box is opened during the operations of the automatic ice making apparatus, and as a result the temperature or the temperature variation rate is changed from the normal values, it is judged as an abnormal state and a predetermined abnormal processing step is carried out in every operation step.

In this embodiment, the thermistor is used as the temperature sensor. However, insofar as it can detect the continuous temperature variation, any sensor can be used.

The automatic ice making apparatus according to the present invention has following effects.

(1) A time required for making ice can be reduced considerably, because a time between the completion of the freezing of water and the judgement of the freeze of water can be reduced considerably compared with that in the prior art. Further, the power consumption of the heater can be reduced, because a time between the actual separation of ice and the deenergization of the heater can be reduced.

(2) The inconvenience in the prior art such as the water overflow due to the water supply of plural times, and an abnormal stopping etc. in each operation of the water supply, cooling and heating for removing ice from the ice making tray can be obviated in the present invention, because the actual operating states can be recognized precisely and a suitable action can be carried out when the abnormal state is generated.

Further, in case that the overheated state is detected in the course of heating for separating ice from the ice making tray, the heater can be deenergized before the temperature huse is cut, so that the frequency of the claim of the user and the maintenance service can be reduced, because the case of cut of the temperature fuse becomes few.

(3) An electric power required for the electromagnetic valve for use in the water supply mechanism, the electric motor for use in the ice discharging mechanism and the electric heater for separating ice from the ice making tray is about 100 times larger than an electric power required for the operation of the electronic control circuit. Accordingly, if the electromagnetic valve for use in the water supply mechanism, the electric motor for use in the ice discharging mechanim and the electric heater for separating ice from the ice making tray are of the type to be operated by the direct current, a large capacity of DC power source is required. If at least one of the electromagnetic valve for use in the water supply mechanism, the electric motor for use in the ice discharging mechanism and the electric heater for separating ice from the ice making tray is of the type to be operated by the AC power source, the cost of the DC power source can be reduced. It is a matter of fact that if all of the electromagnetic valve for use in the water supply mechanism, the electric motor for use in the ice discharging mechanism and the electric heater for separating ice from the ice making tray are formed of the type to be operated by the AC power source, the cost reduction effect becomes the highest.

(4) If the range of allowance of the input voltage of the DC power source is wide, such as between AC 85V and AC 250V, an apparatus common to the different specifications of the AC power source in the world can be used, though the cost of the DC power source would be increased.

In the other embodiment of the present invention, the microprocessor 6 shown in FIG. 2 reads the output voltage of the thermistor 4 sequentially and A/D converts it.

After a time waiting during which the detected temperature is lowered at about −5° C., the triacs 9 are turned ON temporarily (4 seconds, for example) by the control signal from the microprocessor 6 through the gate drive circuit 7, so that the solenoid valve 8 for supplying water is opened to supply water into the ice making tray. It is preferable that at the first time of water supply the water supply is continued until water reachs the thermistor 4 in case that the conditions of the water pressure or the like are not wrong. By the microprocessor 6, the triacs 9 are turned OFF and after a time waiting (5 seconds, for example) during which water reaches the thermistor 4 and the thermistor 4 is reacted, the output voltage of the thermistor is read, A/D converted and compared with the temperature (in this case, more that 1.5° C., for example) at the begining time of the water supply. If the temperature after the water supply is elevated from the temperature at the begining time of the water supply more than a predetermined temperature (more than 1.5° C., for example), it is judged that the water level detection is completed. If the temperature is not elevated more than the predetermined temperature, it is judged that the water pressure is dropped or the like, so that a little quantity of water is added (corresponding to 0.9 sec, for example). Said time waiting, temperature comparison and water addition are repeated, and the water supply is finished when the water level detection is completed. At this stage, if the number of repetition time of the water addition is over a predetermined value (8 times, for example), it is judged that the water supply mechanism, the sensor mechanism or the like becomes abnormal state, so that a predetermined action corresponding to the abnormal state is carried out.

Figure 4:
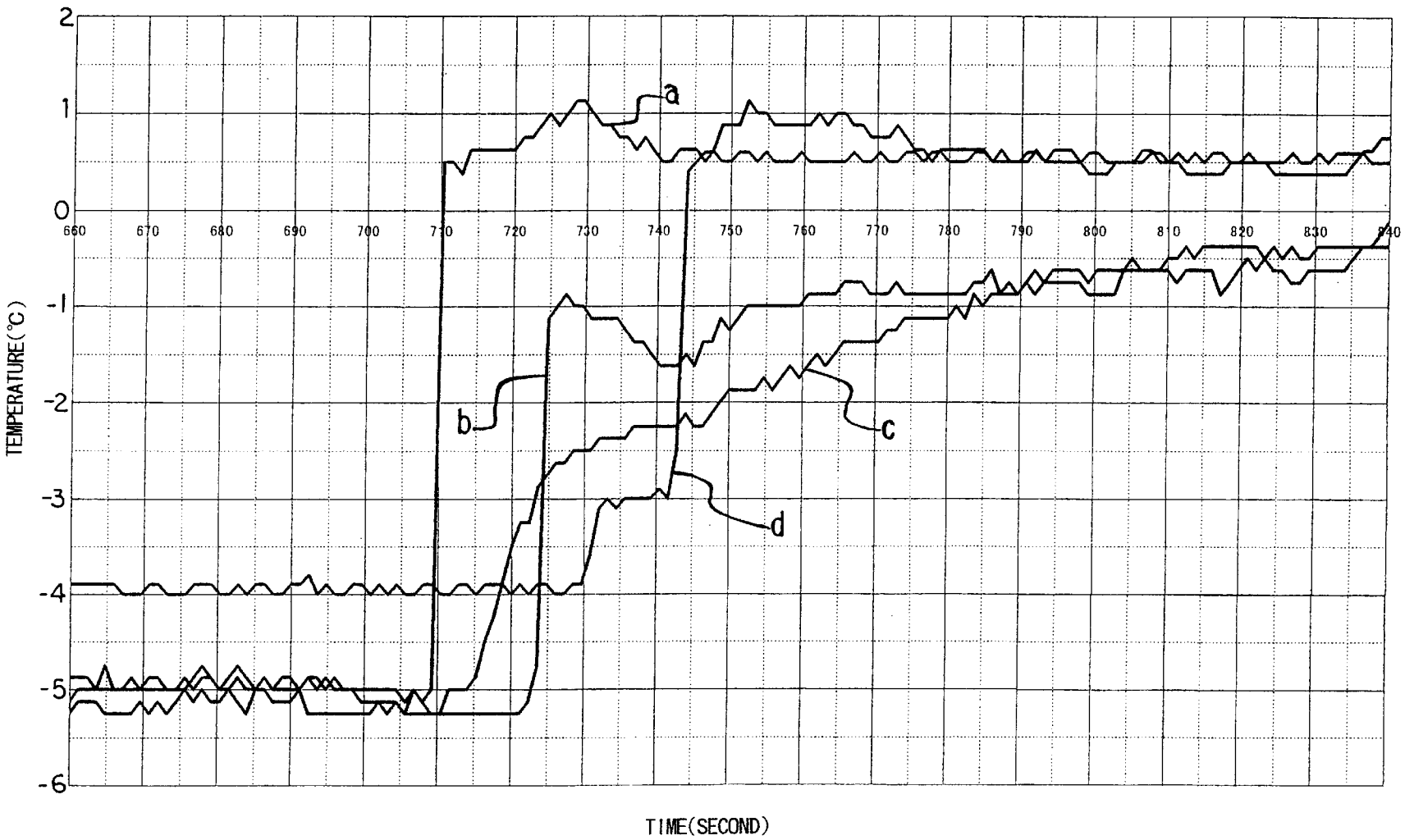
FIG. 4 shows data of experiment for a water level detection according to the automatic ice making apparatus of the present invention.
Figure 5:
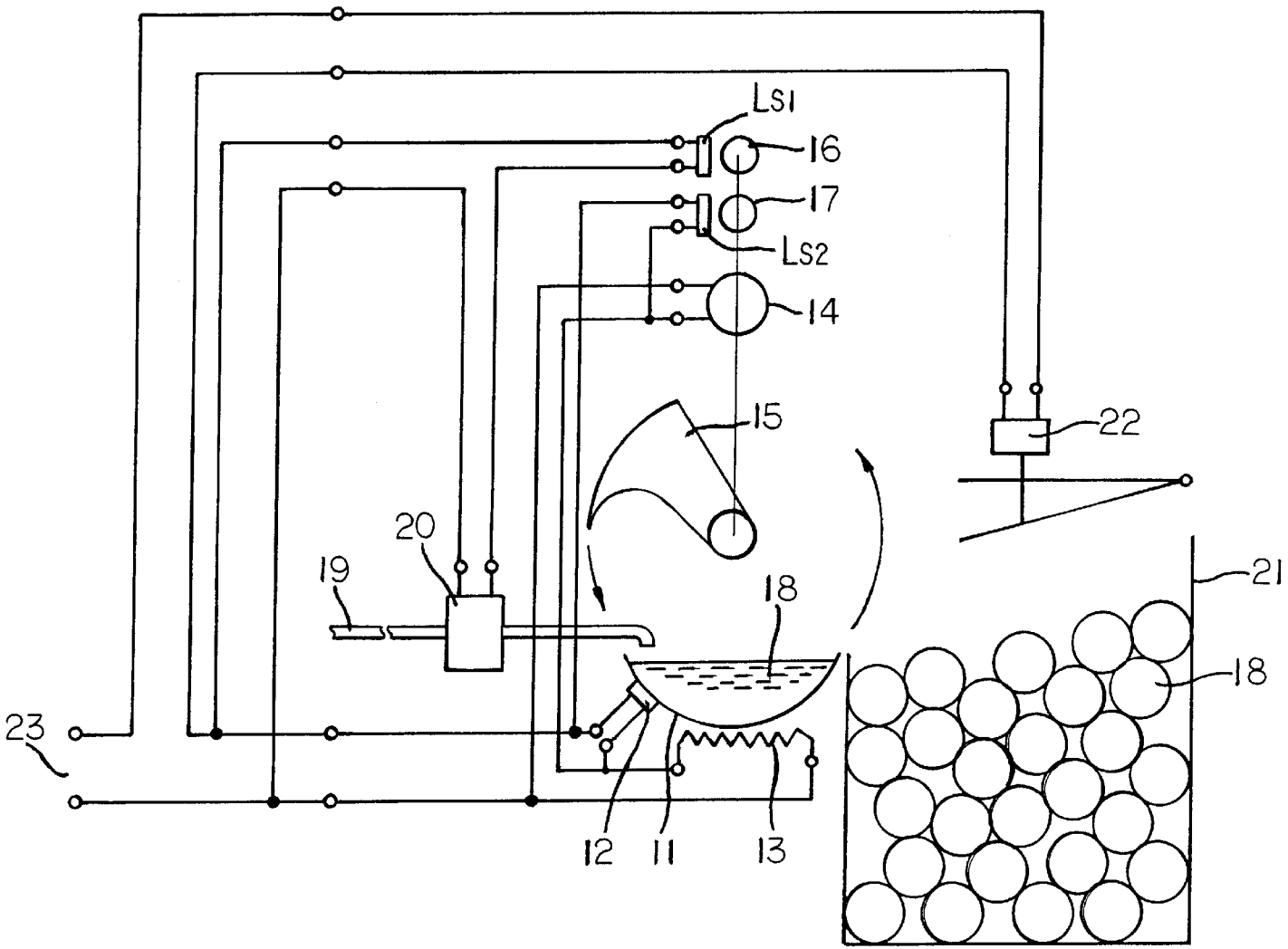
FIG. 5 shows a conventional ice making apparatus.

The water supply process will be explained with reference to FIG. 4. In FIG. 4, a reference simple a designates a change of temperature in a cube near the water supply port, b designates a change of temperature in the cube near the thermistor, c designates a change of temperature of the ice making tray itself and d designates a change of temperature detected by the thermistor 4. The water supply is started when the temperature in the cube near the water supply port reaches −5° C., so that the temperature is elevated to the water temperature (about 0.5° C.). The temperature in the cube near the thermistor is elevated to about −1° C. after about 15 seconds during which water reaches the cube near the thermistor. Further, the temperature detected by the thermistor 4 is elevated to the water temperature (about 0.5° C.) after about 18 seconds during which water reaches the thermistor 4 and the thermistor reacts. At this stage, an elevated value of the temperature detected by the thermistor 4 is about 4.5° C., so that the water level detection is completed when the elevated value is detected.

As shown by the above data, the rate of elevation of the temperature detected by the thermistor 4 is higher than the rate of elevation of the temperature of the ice making tray itself.

After completion of the above water supply process, the output voltage of the thermistor 4 is read sequentially, A/D converted and shifted to an ice making completion detecting sequence by the microprocessor 6. By the microprocessor 6, the triacs 9 are turned ON through the gate drive circuit 7 to energize the heater 1 and the ice discharging motor 2. Then the ice discharging motor 2 is rotated and the claw of the ice discharging mechanism is brought into abutment with ice, the ice discharging motor 2 is deenergized for a while. The deenergized state of the ice discharging motor is released and ice is discharged, when the temperature of the ice making tray is elevated by the heater 1 and a portion of ice contacting with the ice making tray is melted and separated from the ice making tray. After completion of the discharge of ice, the heater 1 is deenergized and the claw of the ice discharging mechanism is stopped at a predetermined position, so that one cycle of the ice making operation is finished.

Following operations are the same with the previous embodiment.

Further, the microprocessor including the A/D converter may be formed of two chips consisting of an A/D converter and a microprocessor. A control circuit using no microprocessor may be used. The power switching element for driving the motor etc. may be formed of a mechanical contact of relay or the like. The motor is not limited to the single phase AC motor. The limit switch for the stored ice sensor may be fromed of a magnetic type switch using a magnetic flux and a hale element, for example, or of a photosensor or the like.

A sensor mounting manner for realizing easily by a sensor both of the water level detection and the ice detection will be explained.

In order to detect the freeze of water, that is, to measure precisely the temperature of the ice making tray, it is preferably that the sensor is intimate contacted with the ice making tray or embeded directly into the ice making tray. However, in case that the heat capacity of the ice making tray is large (in this embodiment, the ice making tray is made of aluminum die casting), the temperature detected by the sensor depends on the temperature of the ice making tray rather than the water temperature, so that the water level detection is difficult. Accordingly, the sensor is positioned so as to contact directly a portion thereof with water, and further the sensor is mounted on the ice making tray through a material of low in heat conductivity (resin, in this embodiment) in order to reduce the thermal connection between the sensor and the ice making tray.

It goes without saying that the same effect can be obtained by using more than two sensors in order to measure each of the temperatures precisely.

According to this embodiment, it is no need to add a dedicated water level sensor and provide a circuit for heating the thermistor, and a predetermined amount of water can be supplied by processing the software of the microprocessor, while suppressing the inconvenience such as the water amount change due to the water pressure change.

POSSIBILITY OF UTILIZATION IN THE INDUSTRY

As stated above, according to the automatic ice making apparatus of the present invention the power consumption can be reduced effectively.

Further, it will be understood by those skilled in the art that the present invention is not limited to the above embodiments and includs a scope of the invention as defined by the appended claims.

What is claimed is:

1. An automatic ice making apparatus for use in a home refrigerating box comprising a water supply mechanism, an ice making tray, an ice discharging mechanism, a heater for separating ice, a temperature sensor for the ice making tray, an amount of stored ice detecting mechanism and an electronic control circuit for controlling the above mentioned components, wherein said components other than said water supply mechanism are positioned in a freezing chamber, the sensor detects continuously the temperature of the ice making tray, and the completion of freeze of water is determined when the temperature of the ice making tray is lower than 0° C., a state of a dropping rate of the temperature of the ice making tray is small and continued and then the dropping rate of the temperature is increased, and when an output change of the sensor becomes a predetermined value the water supply is stopped so as to supply a predetermined amount of water.

2. An automatic ice making apparatus for use in a home refrigerating box comprising a water supply mechanism, an ice making tray, an ice discharging mechanism, a heater for separating ice, a temperature sensor for the ice making tray, an amount of stored ice detecting mechanism and an electronic control circuit for controlling the above mentioned components, wherein said components other than said water supply mechanism and the electronic control circuit are positioned in a freezing chamber, the sensor detects continuously the temperature of the ice making tray, and the completion of freeze of water is determined when the temperature of the ice making tray is lower than 0° C., a state of a dropping rate of the temperature of the ice making tray is small and continued and then the dropping rate of the temperature is increased, and when an output change of the sensor becomes a predetermined value the water supply is stopped so as to supply a predetermined amount of water.

3. An automatic ice making apparatus as claimed in claim 1, characterized in that said sensor is arranged at a required position of said ice making tray.

4. The automatic ice making apparatus as claimed in claim 3, characterized in that water is supplied when the temperature detected by the sensor is lower than 0° C., and then the temperature elevation of water in the ice making tray is detected.

5. The automatic ice making apparatus as claimed in claim 1, characterized in that a signal processing portion of said electronic control circuit is composed of an electronic circuit having an A/D converter and a microprocessor or a microprocessor including the A/D converter.

6. The automatic ice making apparatus as claimed in claim 1, characterized in that a signal processing portion of said electronic control circuit is composed of an electronic circuit having such a detecting function that the temperature and the temperature variation rate of the ice making tray can be detected.

7. The automatic ice making apparatus as claimed in claim 1, characterized in that at least one of an electromagnetic valve for use in said water supply mechanism, an electric motor for use in said ice discharging mechanism and said heater for separating ice from the ice making tray is of the type to be energized by an AC power source.

8. The automatic ice making apparatus as claimed in claim 1, characterized in that an electromagnetic valve for use in said water supply mechanism, and electric motor for use in said ice discharging mechanism and said heater for separating ice from the ice making tray are of the type to be energized by a DC power source.

9. The automatic ice making apparatus according to claim 1, wherein the control circuit is configured to determine the completion of freeze of water when the temperature of the ice making tray is lower than 0° C., a state of a dropping rate of the temperature of the ice making tray is small and continued and then the dropping rate of the temperature is increased, and when an output change of the sensor becomes a predetermined value the water supply is stopped so as to supply a predetermined amount of water.

10. The automatic ice making apparatus according to claim 2, wherein the control circuit is configured to determine the completion of freeze of water when the temperature of the ice making tray is lower than 0° C., a state of a dropping rate of the temperature of the ice making tray is small and continued and then the dropping rate of the temperature is increased, and when an output change of the sensor becomes a predetermined value the water supply is stopped so as to supply a predetermined amount of water.

11. An automatic ice making apparatus for use in a home refrigerating box comprising:

a water supply mechanism;

an ice making tray coupled to the water supply mechanism;

an ice discharging mechanism coupled to the ice making tray;

a heater for separating ice coupled to the ice discharging mechanism;

a temperature sensor coupled to the ice making tray;

an amount of stored ice detecting mechanism; and an electronic control circuit coupled to the temperature sensor, wherein the control circuit is configured to detect continuously the temperature of the ice making tray, and wherein the control circuit is further configured to determine the completion of freezing of water based on the temperature of the ice making tray being lower than 0° C. and based on an increase in a temperature dropping rate of the temperature of the ice making tray.

* * * * *